US009205319B2

(12) United States Patent
McQuinn

(10) Patent No.: US 9,205,319 B2
(45) Date of Patent: Dec. 8, 2015

(54) GLOVE CASE

(71) Applicant: Kevin Patrick McQuinn, Tiny (CA)

(72) Inventor: Kevin Patrick McQuinn, Tiny (CA)

( * ) Notice: Subject to any disclaimer, the term of this patent is extended or adjusted under 35 U.S.C. 154(b) by 59 days.

(21) Appl. No.: 14/219,754

(22) Filed: Mar. 19, 2014

(65) Prior Publication Data

US 2015/0265901 A1 Sep. 24, 2015

(51) Int. Cl.

| | |
|---|---|
| ***A63B 71/14*** | (2006.01) |
| ***D06F 59/04*** | (2006.01) |
| ***A45C 13/03*** | (2006.01) |
| ***A63B 71/00*** | (2006.01) |

(52) U.S. Cl.

CPC ..... *A63B 71/0036* (2013.01); *A45C 13/03* (2013.01); *D06F 59/04* (2013.01)

(58) Field of Classification Search

CPC .. D06F 59/04; A63B 71/143; A63B 71/0036; A63B 71/14; A47B 81/00; A45C 13/02; A45C 13/03; A45C 2013/026; A45C 13/002

USPC ..... 223/78, 84

See application file for complete search history.

(56) References Cited

U.S. PATENT DOCUMENTS

| | | | | | |
|---|---|---|---|---|---|
| 3,533,503 | A | * | 10/1970 | Keats et al. | 206/776 |
| 3,880,283 | A | * | 4/1975 | Flaherty et al. | 206/316.1 |
| 4,418,849 | A | | 12/1983 | Santa | |
| 4,565,287 | A | * | 1/1986 | Rede et al. | 206/213 |
| 4,877,162 | A | | 10/1989 | McGinley | |
| 4,958,729 | A | * | 9/1990 | Wright | 206/315.1 |
| 5,267,677 | A | | 12/1993 | Nash | |
| D363,184 | S | * | 10/1995 | Elhage | D6/552 |
| 5,868,368 | A | | 2/1999 | MacDonald | |
| 8,651,342 | B1 | * | 2/2014 | Sexton | 223/78 |
| 8,968,120 | B2 | * | 3/2015 | Sullivan | 473/458 |

* cited by examiner

*Primary Examiner* — Ismael Izaguirre

(57) ABSTRACT

A glove storage case for storing and protecting a glove having glove pocket and palm area having a predefined shape is provided using a closable shape retaining container with a shaper having a shaped surface on which the shaped glove pocket and at least a portion of palm area of the glove is received and which essentially conforms with their pre-defined shapes so that when stored the glove retains its shape. Movement between the glove and shaper is limited when the glove is in position on the shaper without the application of deforming pressure against a side of said glove opposite the shaper.

19 Claims, 4 Drawing Sheets

GLOVE CASE

CROSS REFERENCE TO RELATED APPLICATIONS

Field of Invention

The present invention relates to a case for gloves, particularly baseball gloves where a glove stored therein is protect from the elements and it shape is retained

Background of the Present Invention

Very good gloves used for sports particularly baseball have definite predefined shape that forms, for example. The pocket into which the ball is received when caught. When the glove loses this shape it becomes less suitable for its intended purpose and thus in many cases must be replaced generally at a significant cost. Such changes in shape are facilitated if the glove becomes wet and is not properly died or it is stored for significant periods of time in a distorted shape.

There have been a few proposals that are directed toward solving at least some of these problems. One of the earliest of which Applicant is aware is shown in U.S. Pat. No. 4,418,849 issued Dec. 6, 1983 to Santa which teaches a hinged baseball glove former and carrier made from molded plastic which provides a substantially fixed shape and wherein the plastic is intended to snap back against the glove and apply pressure thereto. The concept is to place a ball into the pocket of the glove and then the glove is folded around the ball. Clearly the intent is to deform the glove ((along it natural fold) to ensure engagement of the ball in the pocket of the glove and to maintain pressure against the glove to maintained it in its distorted shape embracing the ball. Such pressure and distortion of the glove is not an effective way to preserve the shape of the glove.

U.S. Pat. No. 4,877,162 issued Oct. 31, 1989 to McGialey teaches a shaper for distorting the shape of the glove to form a pocket the shape of which is determined by the pliable arms of the device that are attached to the lacing to form the glove into the defined shape.

U.S. Pat. No. 5,267,677 issued Dec. 7, 1993 to Nash describes a pocket forming device that is placed into the pocket of the glove and the glove deformed into contact with the device.

Yet another device is shown in U.S. Pat. No. 5,868,368 issued Feb. 9, 1999 to MacDonald which describes a device using a ball mounted on a pedestal and places the glove so that the pocket of the glove receives the ball and forces (deforms) the glove against the ball.

It is apparent that all the prior art devices require deformation of the glove which is simply not acceptable when practicing the present invention as such deformation changes the shape of the glove thereby making the glove less acceptable and likely will result in the glove being discarded prematurely. Similarly nothing in the prior art provides a case that will protect the glove form weather and from being wetted. A wet glove tends to lose its shape which is what the present invention is intended to minimizes.

BRIEF DESCRIPTION OF THE PRESENT INVENTION

It is an object of the present invention to provide and improved glove case for protecting storing and transporting a playing glove such as a baseball glove while maintaining the shape of the glove.

Broadly the present invention relates to a closable glove storage case for storing and protecting a glove having a ball receiving space defined by surfaces of said glove and which define a palm area with a predefined shape having a mouth opening at its open end a major portion of the periphery of which is defined by free edge of a thumb receiving side of said glove and a free edge a small finger receiving side of said glove interconnected by an edge of a heal of said glove and a glove pocket area positioned at an end of said space remote from said mouth opening, comprising a closable shape retaining container having a base surface, a shaper extending from said base surface having a convex ball resembling surface at its end remote from remote from said base surface and positioned to be received in said glove pocket area of said glove when said glove is in position on said shaper and shaper surface extending between said convex ball resembling surface and said base surface at least adjacent to said thumb receiving portion when said glove is in position on said shaper, said shaper surface being shaped to essentially conform with its adjacent surface of said glove when said glove is positioned on said shaper and means to limit movement between said glove and said shaper when said glove is in position on said shaper without the application of a glove deforming pressure against a side of said glove opposite said shaper when said glove is in position on said shaper.

Preferably, the convex ball resembling surface is spaced from said base so that when said glove is positioned on said shaper said glove pocket area contacts said shaper on said convex ball resembling surface and said base adjacent to said mouth defining portion.

Preferably, a shaper surface interconnects said base surface and said convex ball resembling surface and is positioned to engage with said palm area on both the thumb side and said little finger side of said glove.

Preferably, shaper surface interconnects said base surface and said convex ball resembling surface completely around said mouth opening when said glove is in position on said shaper and said shaper surface essentially conforms to the adjacent surface of said glove when positioned on said shaper over throughout said palm area of said glove.

Preferably, said means to limit movement between said glove and said shaper when said glove is in position on said shaper without the application of pressure against a side of said glove opposite said ball receiving space comprises walls of said shape retaining closable container positioned in close proximity of said glove when said glove is in said container in position on said shaper.

Preferably the shape retaining container is provided with a closable lid that forms at least one of said walls of said container

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
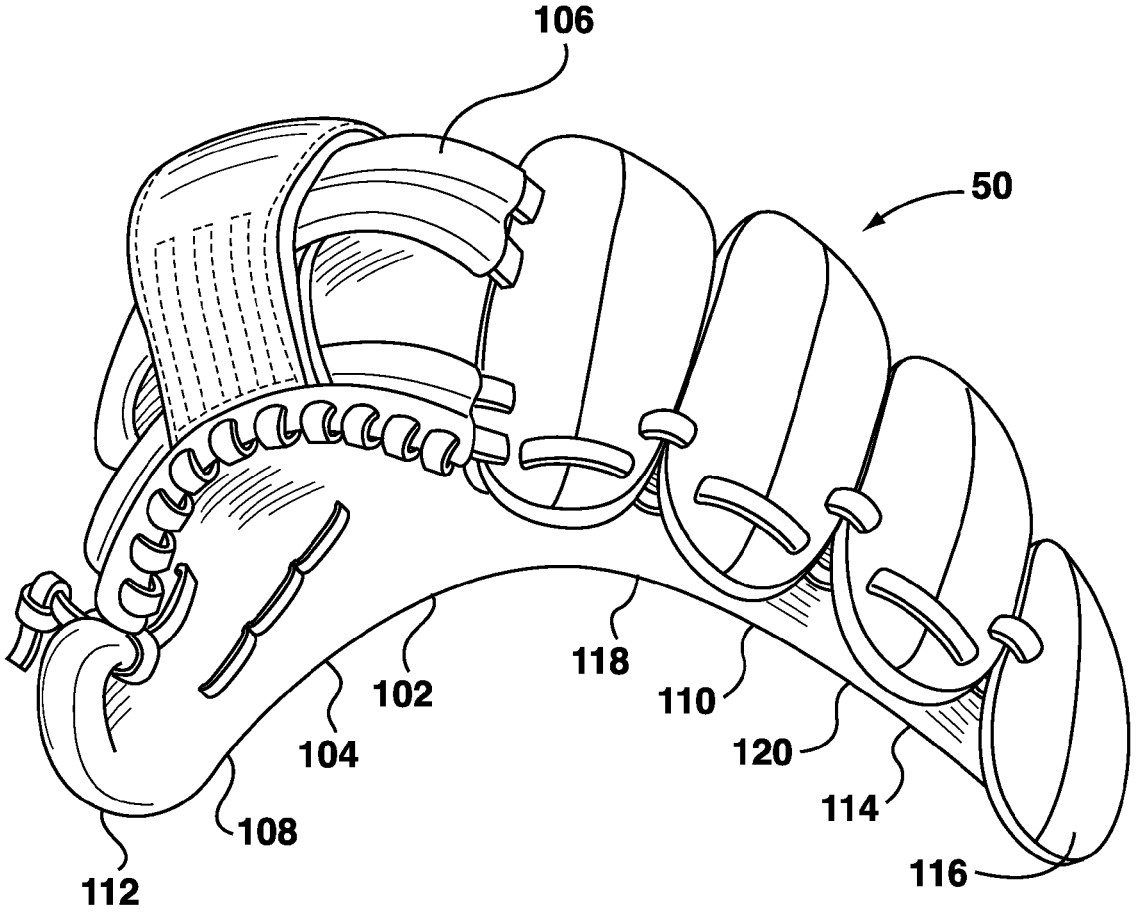
FIG. 1 (Prior Art)
FIG. 1 is an isometric illustration of a typical baseball glove viewed from the free end (looking toward the tips of the finger and thumb receiving portions of the glove.
Figure 1A:
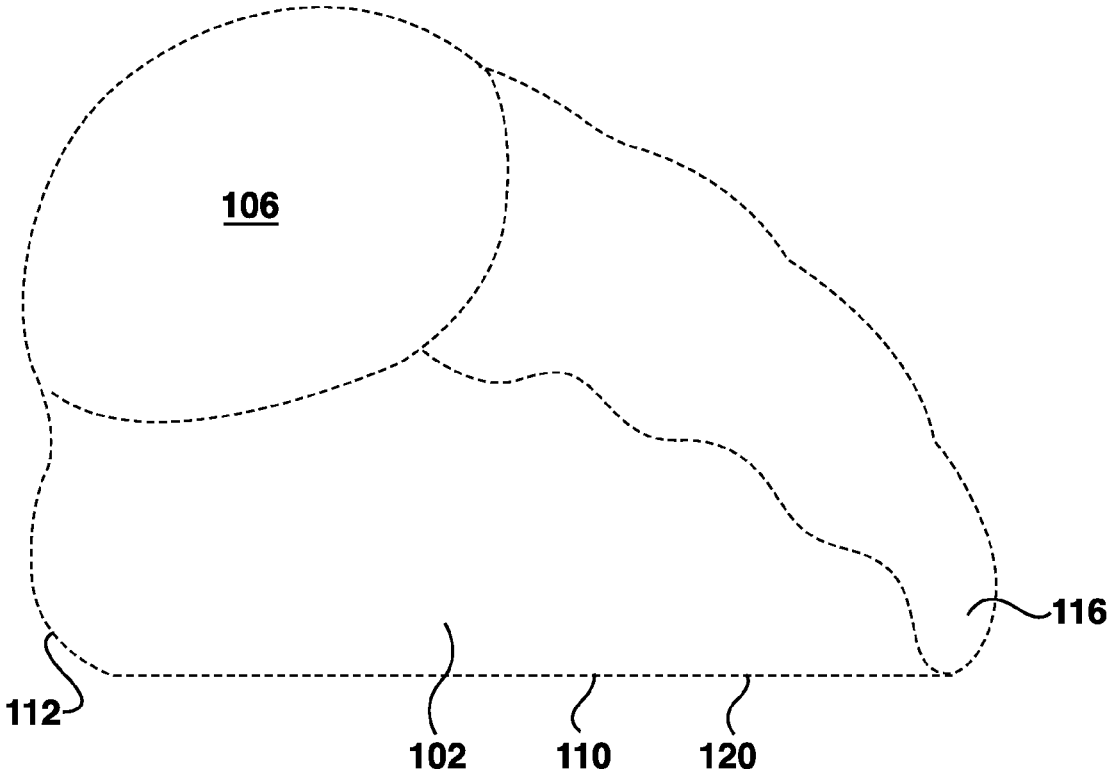
FIG. 1A (Prior Art)
FIG. 1A is a schematic illustration in dash lines outlining the pocket and ball receiving space of the typical glove shown in FIG. 1.
Figure 3A:
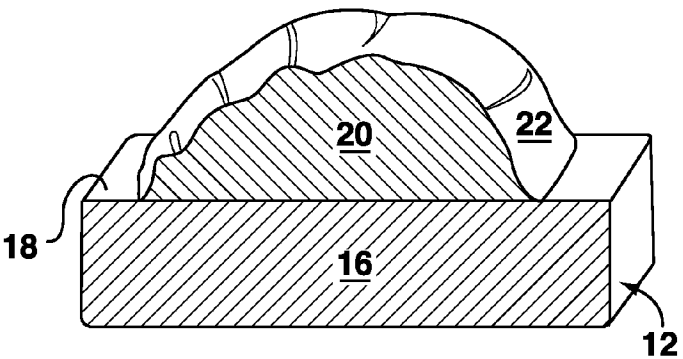
FIG. 3A is a section on the line 3A-3A of FIG. 2A but with the transparent cover removed.

FIGS. 1 and 1A illustrate a typical baseball glove 50 having a ball receiving space defined by surfaces 102 of said glove and which define a palm area surface 104 with a predefined shape and a glove pocket defined by surface 106 positioned at an end of said space 102 remote from a mouth opening 108 a major portion of the periphery of which is defined by free edge 110 of a thumb receiving portion or side 112 and a free edge 114 of a small finger receiving portion or side 116 of the glove 50 interconnected by an edge 118 of a heal of said glove to form a peripheral edge 120. FIG. 1A schematically outlines in dash lines the pocket 106 the peripheral edge 120 ball receiving space 102 and the little finger and thumb outlines 114 and 112 respectively.

Figure 2A:
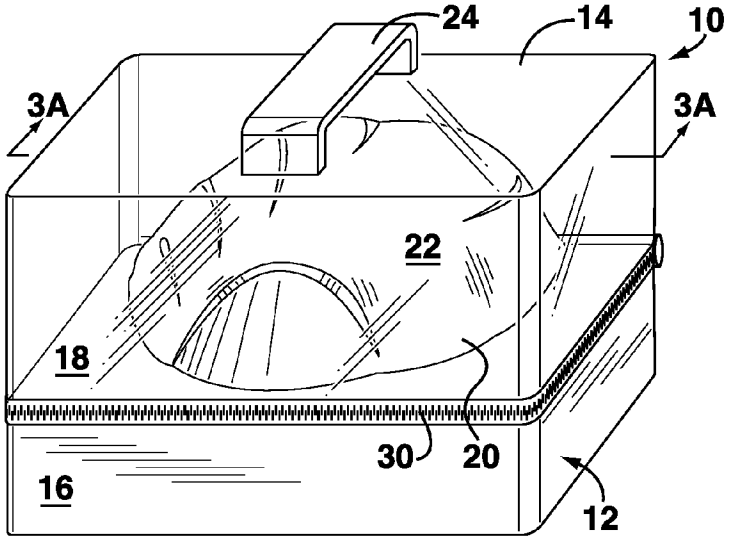
FIG. 2A is a view similar to FIG. 2 but showing the glove case with the glove removed.
Figure 2:
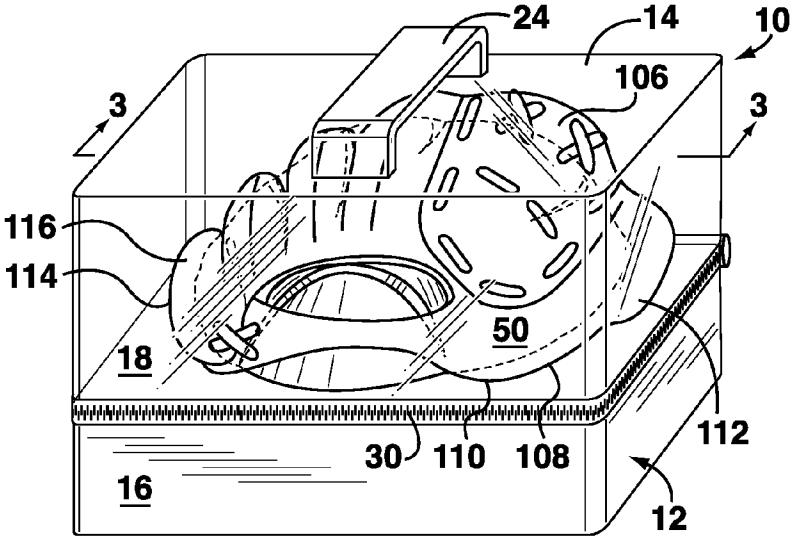
FIG. 2 is a schematic isometric representation showing a glove in position in a glove case of the present invention with the cover transparent cover in a closed position

Turning to FIG. 2 the case 10 of the present invention is in the form of a shape retaining container 12 having a re-closeable lid 14 (transparent in the version illustrated to more clearly illustrate the invention but may be colored, etc.) and a bottom or base 16 that provides a base surface 18. A shaper 20 projects from the base 18 and has a convex ball resembling surface or portion 23 defining its end remote from the base 18 and an exposed shaper surface 22 that extends from edge of surface 23 to the base 18 and is formed as will be described in more detail herein below to essentially mimic the predefined shape of the palm portion 104 of the glove 50 into which it is to be received.

As is well known, high quality gloves 50 are formed with a shaped palm area 104 having a predefined shape that includes a predefined a glove pocket 106 i.e. the gloves each have a specifically shaped palm area 104 which directs the ball being caught to the predefined glove pocket 106 where the ball, when caught, normally comes to rest. The ball pocket 106 is essentially concave to match with the surface of the ball with which it is intended to be used. The shaper surface 22 as described above is contoured to essentially conform to the predefined shape of the palm area 104 of the glove 50 to be received thereon and will include a substantially a convex ball resembling surface or portion 23 that is received in the glove pocket 106 and is coordinated with the size of the ball with which the glove 50 is to be used. Generally the surface 22 extending from the periphery of the convex surface 23 to the base 18 will essentially conform with the adjacent surface 102 of the glove 50. When the glove 50 is in position on the shaper 20 convex portion 23 will contact the adjacent surface of the pocket 106 of the glove 50 as will the base 18 and adjacent edge 120 of the glove 50. By the term essentially conform with it is intended that the surface 22 will just touch the adjacent surface of the glove 50 and in any event will not be spaced more than about 0.25 inches there from when the glove 50 is properly positioned on the shaper 20.

Figure 3:
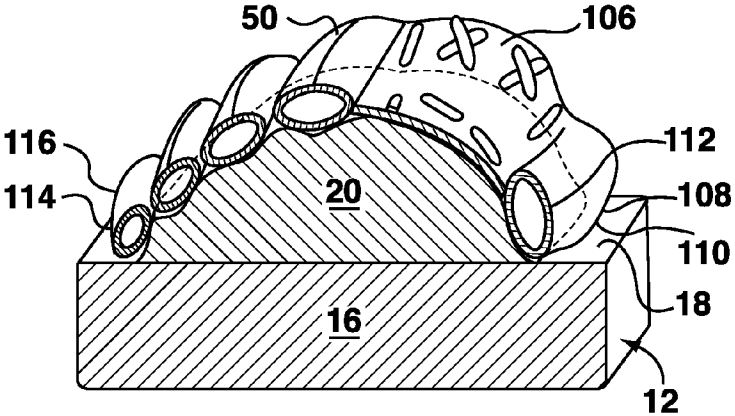
FIG. 3 is a section on the line 3-3 of FIG. 2 but with the transparent cover removed.
Figure 4A:
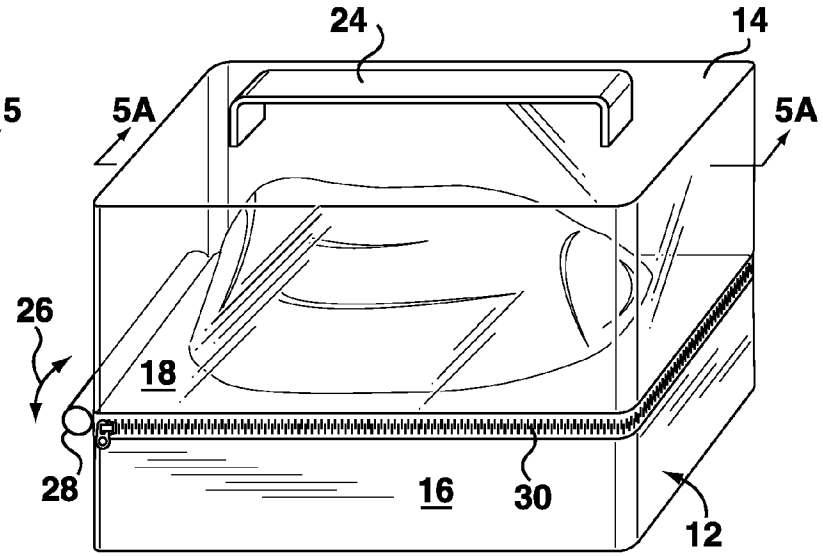
FIG. 4A is a view similar to FIG. 4 but showing the glove case with the glove removed.
Figure 4:
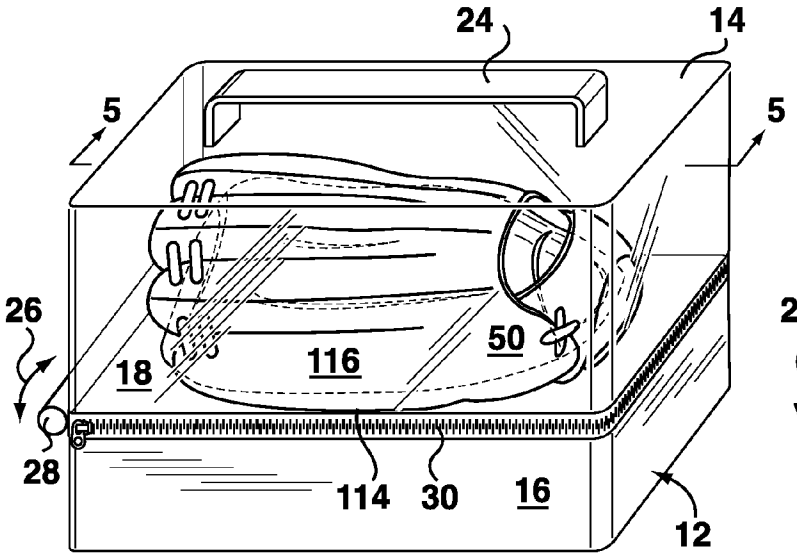
FIG. 4 is a view similar to FIG. 2 but view from a direction perpendicular to that shown in FIG. 2
Figure 5A:
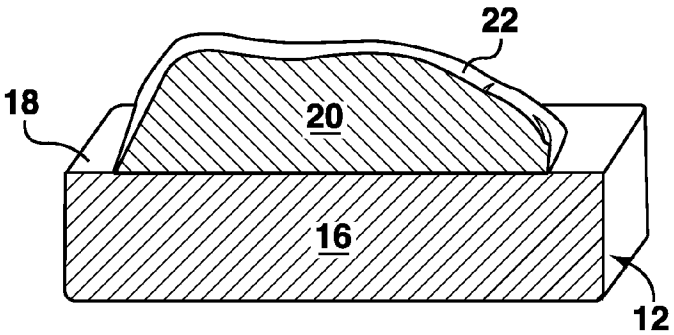
FIG. 5A is a section on the line 5A-5A of FIG. 4A but with the transparent cover removed.
Figure 5:
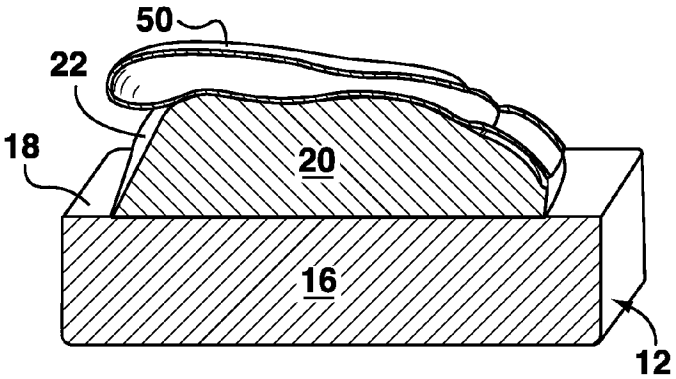
FIG. 5 is a section on the line 5-5 of FIG. 4 but with the transparent cover removed.

As above indicated the surface 22 will generally extend from the convex ball resembling portion 23 to the base 18 from which the shaper 24 extends. Preferably the shaper surface 22 and convex portion 23 will essentially conform to the whole area 102 and glove pocket 106 of the glove 50 that the case is intended to house, however, it also possible to limit the surface 22 so that it only essentially conforms with the glove in the area of the surface 22 that is adjacent to the thumb portion 122 and index finger 127 of the glove 50 (see FIG. 3).

As above indicated, by essentially conform it is intended that that the size of the shaper surface may be equal to or slightly smaller than the corresponding glove surface (i.e. provide, at most, a small clearance between the glove and surface 22 (less than 0.25 inches)) and the height of convex surface 23 above the base surface 18 is the depth of the pocket 106 in the glove 50 so that when the glove 50 is in proper position on the shaper 20 its peripheral edge 120 rests on the base surface 18 and pocket 106 on the convex ball resembling surface or portion 23 and the remainder of the surface is positioned relative to the surface 22 as described above. It will also be apparent that the term essentially conform does not require complete conformity the surface 22 could be dimpled, striated, etc. provided it is in position to prevent significant distortion of the glove.

As shown particularly in FIGS. 2, 2A, 4, 4A the top or closure 14 is provided with a handle 24 for opening and closing the top by in the illustrated version pivoting as schematically indicated by the arrow 26 on hinge 28 (see FIGS. 3 and 4) between open position (not shown) with the glove 50 or surface 22 fully exposed and the closed position as illustrated 14.

When the case 10 is closed with a glove 50 mounted on the shaper 20 the sides and top of the case will be in close proximity to the glove 50 to prevent significant dislocation of the glove relative to the shaper 20 i.e. at the closest point(s) the glove to the walls of the case 10 will not normally be more that 0.5 inches from the adjacent wall or top. Also the contact between the glove 50 and the shaper 20 tends to hold the glove in position on the shaper 20. It is also possible to include a foam or the like (not shown) on the inside of the case particularly along the inside the top that may apply a slight pressure to hold the glove 50 in place on the shaper 22 when the case is closed. Any contact between the such foam and the glove 50 will not apply sufficient pressure to deform the glove i.e. the glove in position in the case 10 will not be subject to any pressure that could distort the glove as the foam will collapse to limit the pressure applied be significantly less than that required to distort the glove 50 by only using a foam that compresses significantly more easily than the glove may be deformed.

The lid or closure 14 may be held in closed position and the container or case 12 maintained substantially waterproof to protect a glove contained therein by any suitable closure means—for example by telescoping with the base and/or a wall extension project from the base surface 18 around its periphery away therefrom; in the illustrated arrangement a zipper type closure 30 has been provided but any suitable means may be employed.

Having described the invention, modifications will be evident to those skilled in the art without departing from the scope of the invention as defined in the appended claims.

The invention claimed is:

1. A closable glove storage case for storing and protecting a glove having a ball receiving space defined by surfaces of said glove and which define a palm area with a predefined shape having a mouth opening at its open end a major portion of the periphery of which is defined by a free edge of a thumb receiving side of said glove and a free edge of a small finger receiving side of said glove interconnected by an edge of a heal of said glove and a glove pocket area positioned at an end of said space remote from said mouth opening, comprising a closable shape retaining container having a base surface, a shaper extending from said base surface having a convex ball resembling surface at its end remote from said base surface and positioned to be received in said glove pocket area of said glove when said glove is in position on said shaper and a shaper surface extending between said convex ball resembling surface and said base surface at least adjacent to said thumb receiving portion when said glove is in position on said shaper, said shaper surface being shaped to essentially conform with its adjacent surface of said glove when said glove is positioned on said shaper and means to limit movement between said glove and said shaper when said glove is in position on said shaper without the application of a glove deforming pressure against a side of said glove opposite said shaper when said glove is in position on said shaper.

2. A closable glove storage case as defined in claim 1, wherein said convex ball resembling surface is spaced from said base so that when said glove is positioned on said shaper said glove pocket area contacts said shaper on said convex ball resembling surface and said base adjacent to said mouth defining portion.

3. A closable glove storage case as defined in claim 2, wherein a shaper surface interconnects said base surface and said convex ball resembling surface and is positioned to engage with said palm area on both the thumb side and said little finger side of said glove.

4. A closable glove storage case as defined in claim 3, wherein said means to limit movement between said glove and said shaper when said glove is in position on said shaper without the application of pressure against a side of said glove opposite said ball receiving space comprises walls of said shape retaining closable container positioned in close proximity of said glove when said glove is in said container in position on said shaper.

5. A closable glove storage case as defined in claim 4, wherein said shape retaining container is provided with a closable lid that forms at least one of said walls of said container.

6. A closable glove storage case as defined in claim 2, wherein said shaper surface interconnects said base surface and said convex ball resembling surface completely around said mouth opening when said glove is in position on said shaper and said shaper surface essentially conforms to the adjacent surface of said glove when positioned on said shaper over throughout said palm area of said glove.

7. A closable glove storage case as defined in claim 6, wherein said means to limit movement between said glove and said shaper when said glove is in position on said shaper without the application of pressure against a side of said glove opposite said ball receiving space comprises walls of said shape retaining closable container positioned in close proximity of said glove when said glove is in said container in position on said shaper.

8. A closable glove storage case as defined in claim 6, wherein said shape retaining container is provided with a closable lid that forms at least one of said walls of said container.

9. A closable glove storage case as defined in claim 2, wherein said means to limit movement between said glove and said shaper when said glove is in position on said shaper without the application of pressure against a side of said glove opposite said ball receiving space comprises walls of said shape retaining closable container positioned in close proximity of said glove when said glove is in said container in position on said shaper.

10. A closable glove storage case as defined in claim 9, wherein said shape retaining container is provided with a closable lid that forms at least one of said walls of said container.

11. A closable glove storage case as defined in claim 1, wherein said shaper surface interconnects said base surface and said convex ball resembling surface and is positioned to engage with said palm area on both the thumb side and said little finger side of said glove.

12. A closable glove storage case as defined in claim 11, wherein said means to limit movement between said glove and said shaper when said glove is in position on said shaper without the application of pressure against a side of said glove opposite said ball receiving space comprises walls of said shape retaining closable container positioned in close proximity of said glove when said glove is in said container in position on said shaper.

13. A closable glove storage case as defined in claim 12, wherein said shape retaining container is provided with a closable lid that forms at least one of said walls of said container.

14. A closable glove storage case as defined in claim 1, wherein said shaper surface interconnects said base surface and said convex ball resembling surface completely around said mouth opening when said glove is in position on said shaper and said shaper surface essentially conforms to the adjacent surface of said glove when positioned on said shaper over throughout said palm area of said glove.

15. A closable glove storage case as defined in claim 14, wherein said means to limit movement between said glove and said shaper when said glove is in position on said shaper without the application of pressure against a side of said glove opposite said ball receiving space comprises walls of said shape retaining closable container positioned in close proximity of said glove when said glove is in said container in position on said shaper.

16. A closable glove storage case as defined in claim 15, wherein said shape retaining container is provided with a closable lid that forms at least one of said walls of said container.

17. A closable glove storage case as defined in claim 14, wherein said shape retaining container is provided with a closable lid that forms at least one of said walls of said container.

18. A closable glove storage case as defined in claim 1, wherein said means to limit movement between said glove and said shaper when said glove is in position on said shaper without the application of pressure against a side of said glove opposite said ball receiving space comprises walls of said shape retaining closable container positioned in close proximity of said glove when said glove is in said container in position on said shaper.

19. A closable glove storage case as defined in claim 18, wherein said shape retaining container is provided with a closable lid that forms at least one of said walls of said container.

* * * * *